US005647776A

United States Patent [19]

Duclos et al.

[11] Patent Number: 5,647,776

[45] Date of Patent: Jul. 15, 1997

[54] ELECTRICAL CONNECTOR

[75] Inventors: Jean-Louis Duclos, Elancourt; David Rognerud, Vaux sur Seine, both of France

[73] Assignee: Connecteurs Cinch, Montigny le Bretonneux, France

[21] Appl. No.: 576,016

[22] Filed: Dec. 21, 1995

[30] Foreign Application Priority Data

Jan. 19, 1995 [FR] France ..... 95 00594

[51] Int. Cl.[6] ..... H01R 13/436

[52] U.S. Cl. ..... 439/752; 439/314

[58] Field of Search ..... 439/752, 368, 439/332–335, 314

[56] References Cited

U.S. PATENT DOCUMENTS

| | | | |
|---|---|---|---|
| 4,698,030 | 10/1987 | Ryll et al. | 439/752 |
| 4,934,963 | 6/1990 | Gardner et al. | 439/752 |
| 4,936,798 | 6/1990 | Hass et al. | 439/752 |
| 5,135,416 | 8/1992 | Hass et al. | 439/752 |

FOREIGN PATENT DOCUMENTS

| | | |
|---|---|---|
| 0352087 | 1/1990 | European Pat. Off. . |
| 0356251 | 2/1990 | European Pat. Off. . |
| 0416623 | 3/1991 | European Pat. Off. . |

*Primary Examiner*—Gary F. Paumen

*Attorney, Agent, or Firm*—Greenblum & Bernstein P.L.C.

[57] ABSTRACT

An electrical connector comprises a housing member, a coupling sleeve and a complementary member. The housing member is adapted to contain electrical contacts and is inserted in the sleeve. Turning the sleeve simultaneously locks it to the complementary member and locks the contacts in the housing member.

12 Claims, 9 Drawing Sheets

FIG. 2
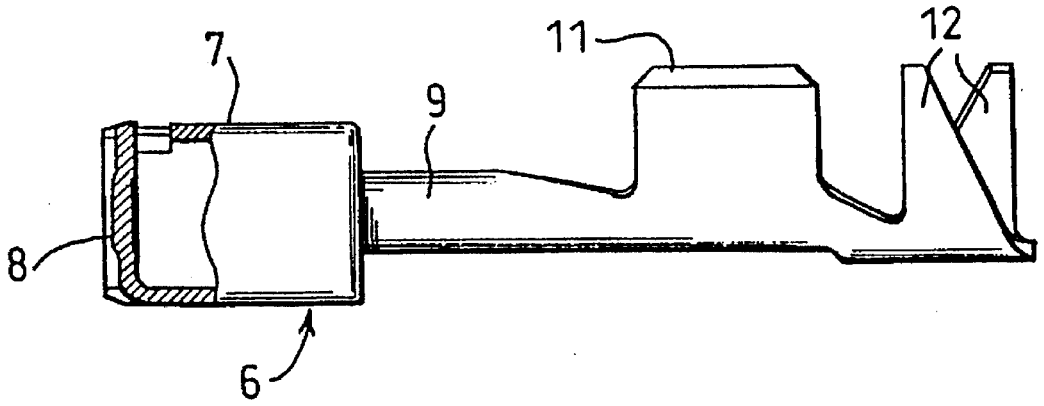
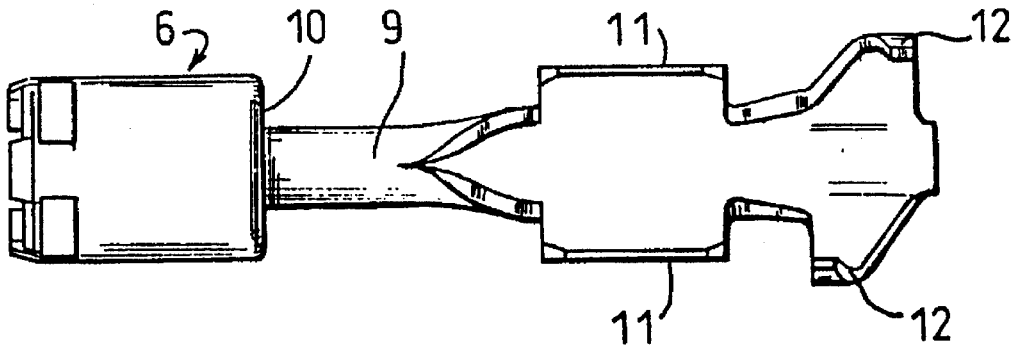
FIG. 3

ELECTRICAL CONNECTOR

BACKGROUND OF THE INVENTION

1. Field of the Invention

The present invention concerns an electrical connector.

The invention concerns an electrical connector comprising a housing member accommodating electrical contact members and a complementary housing member comprising electrical contact members adapted to cooperate with those of the housing member.

2. Description of the Prior Art

In the prior art, the housing member includes members for locking the electrical contact members and members for coupling and locking together the housing members.

An arrangement of this kind is relatively complex.

One object of the present invention is to remedy this drawback.

SUMMARY OF THE INVENTION

Electrical connector comprising a housing member including passages adapted to contain electrical contact members fixed to the ends of electrical conductors and a complementary member including electrical contact members adapted to cooperate with those of the housing member, which connector includes a coupling sleeve including means for receiving the housing member, pre-locking means for placement of the electrical contact members in the passages, means for locking said electrical contact members inserted in the passages and means for fixing it to the complementary member, turning the coupling sleeve relative to the complementary member simultaneously locking it thereto and positioning the locking members so that they lock the electrical contact members in said passages.

Accordingly, a single member performs the various locking functions.

In accordance with one design feature the housing member and the complementary member comprise means for locking them angularly together.

In accordance with another design feature the housing member has a body having a groove near one end and cut-outs in its intermediate part opening into the passages, the coupling sleeve having on its inside projections adapted to cooperate with the groove, pre-locking tongues adapted to be inserted in the cut-outs and locking studs, the electrical contact members housed in the passages having a shoulder with which the tongues cooperate in a pre-locked position, the locking studs cooperating with the shoulders upon turning the coupling sleeve.

To prevent the housing member from turning in the coupling sleeve in the pre-locked position the coupling sleeve has on its side a pre-locking strip with a protuberance adapted to cooperate with a recess in the housing member in the pre-locked position of the coupling sleeve.

In accordance with one design detail the housing member has towards the end facing the complementary member a centering lug around which is a skirt and the complementary member includes a bushing adapted to receive a corresponding end of the coupling sleeve, the bushing having at the back a recess adapted to receive the centering lug and a groove in which the skirt is inserted, fingers upstanding from the back of the bushing being adapted to cooperate with the skirt and steps formed in sectors of the housing member.

In accordance with another design detail the means for fixing the coupling sleeve and the complementary member together comprise a bayonet coupling system.

Finally, the end of the housing member opposite that facing towards the complementary member includes pillars extending inside the coupling sleeve and adapted to fix a seal.

A specific embodiment of the invention will now be described in more detail, by way of example only and with reference to the appended drawings.

BRIEF DESCRIPTION OF THE DRAWINGS

FIG. 2 is an elevational view of an electrical contact member adapted to be fitted to the connector in accordance with the invention.

FIG. 3 is a top view of the member from FIG. 2.

DETAILED DESCRIPTION OF THE PREFERRED EMBODIMENT

The connector shown in the figures comprises a housing member 1, a coupling sleeve 2 and a complementary member 3.

Figure 1:
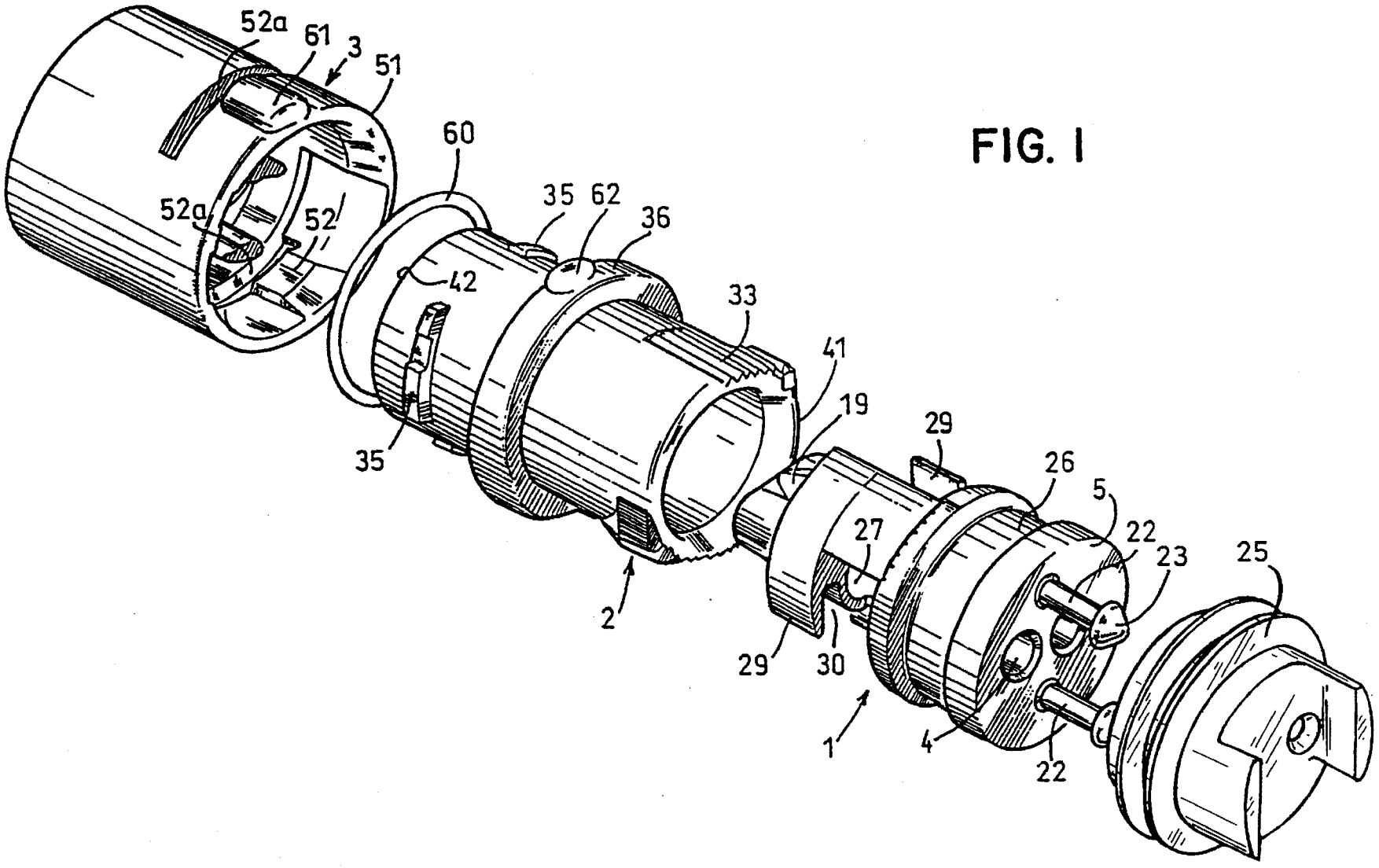
FIG. 1 is an exploded perspective view of a connector in accordance with the invention.
Figure 4:
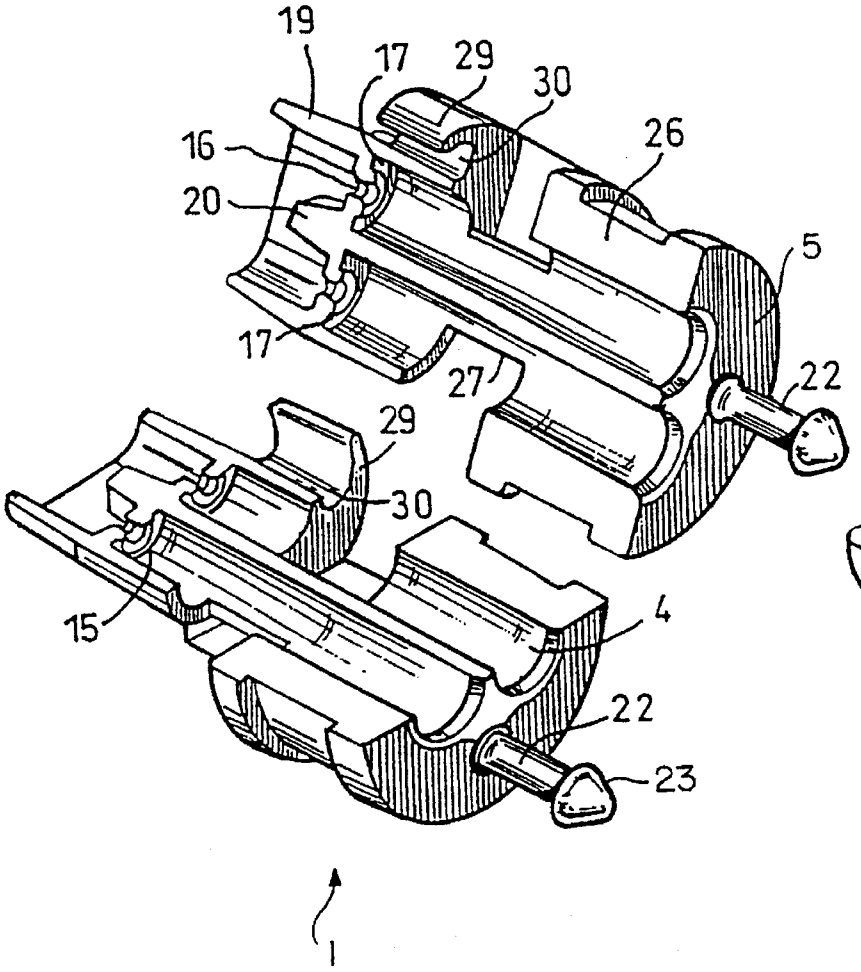
FIG. 4 is an exploded perspective view showing the housing member in cross-section.

The housing member 1 includes two passages 4 which open onto one end 5 and each of which is adapted to receive an electrical contact member 6 (see FIGS. 1 and 4).

The electrical contact member 6 comprises a cylindrical body 7 one end 8 of which has a projecting part adapted to cooperate with a contact formed by a buffer 18 made from a material that is a good conductor of electricity.

At the end opposite the cylindrical body 7, the member 6 is extended by a rod 9 of smaller diameter than the body and joined to the latter through a shoulder 10, said rod terminating in lugs 11 and 12 adapted to be crimped to a previously stripped electrical conductor (see FIGS. 2 and 3).

Figure 8:
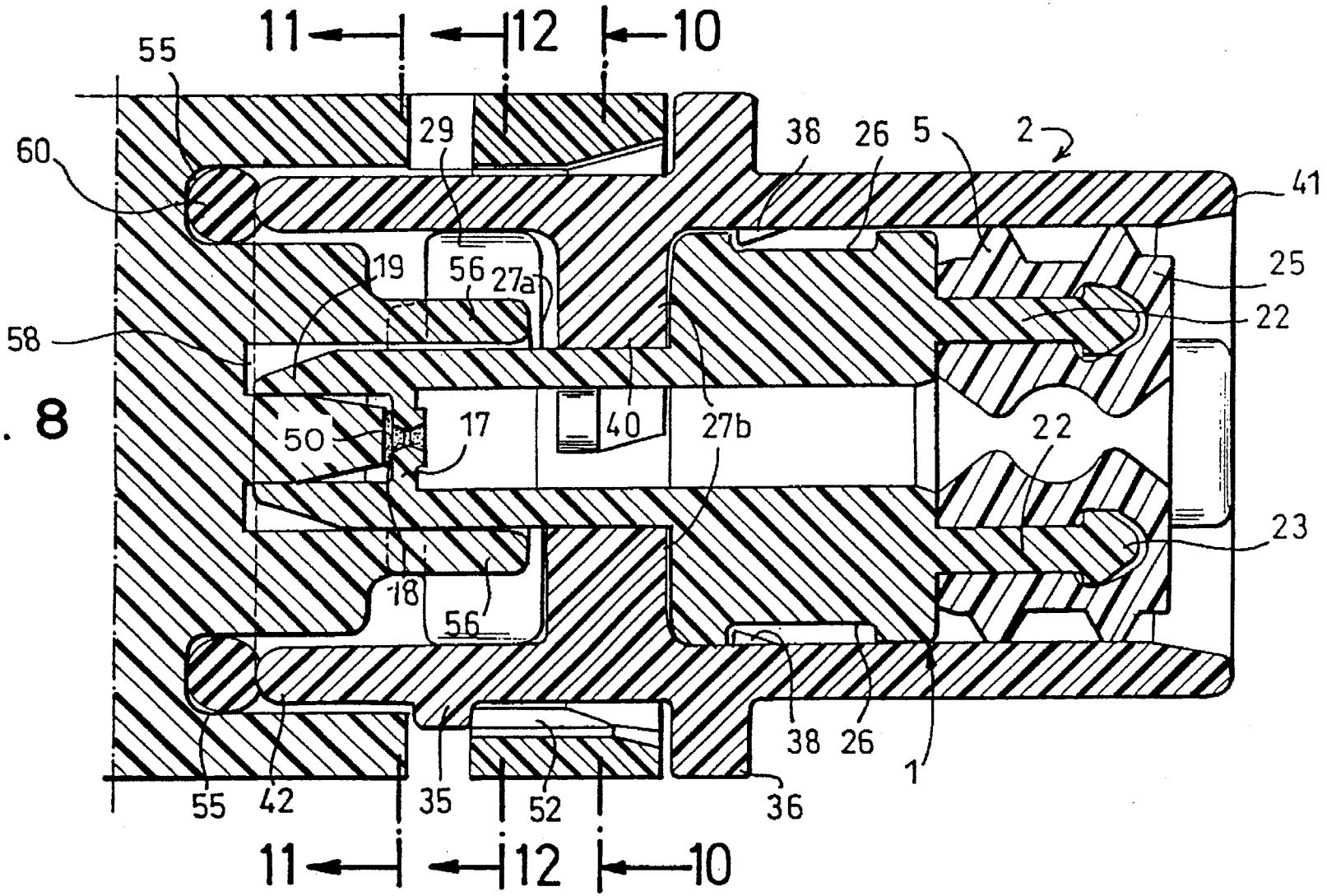
FIG. 8 is a cross-sectional view along line 8—8 in FIG. 7.

Each passage 4 is closed at an intermediate point along its length by a wall 17 in which there is a hole 16 in which the buffer 18, as illustrated in FIG. 8 is accommodated.

The end 5 is provided with two pillars 22 terminating at a head 23 and adapted to fix a seal 25. At the other end said housing member 1 is extended by a skirt 19 with a centering lug 20 in its central part.

The body of the housing member 1 includes a groove 26 and two cut-outs 27 delimited by two edges **27*a* and 27*b*** which open into the passages 4, the part of said passages between the wall 17 and the end of the corresponding cut-out 27*a* having a length corresponding to that of the body 7.

Between the cut-outs 27 and the wall 17 the housing member has two sectors 31 offset circumferentially by 180° and extended by tongues 29 which delimit slots 30 on the side opposite the tongues, the sectors forming a step 24.

Figure 5:
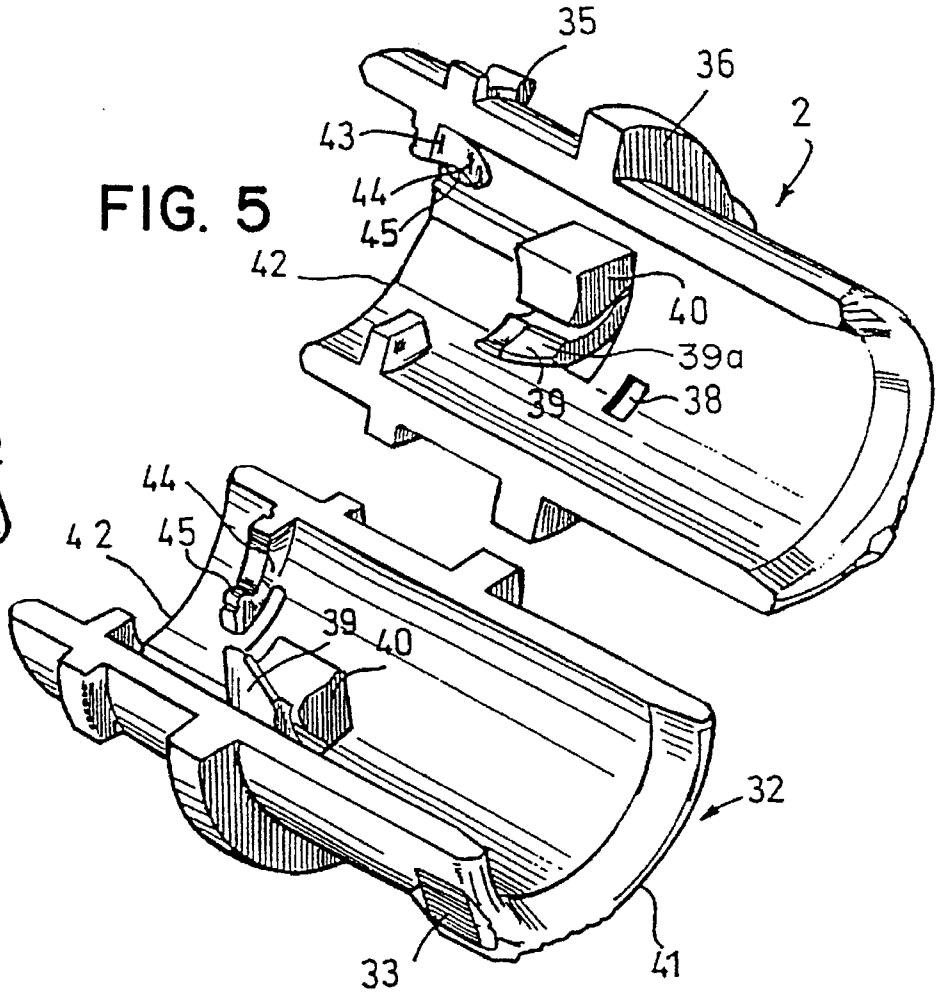
FIG. 5 is an exploded perspective view showing the coupling sleeve in cross-section.

The coupling sleeve 2 (see FIG. 5) has an elongate body 32 open at both ends 41 and 42, with gripping means 33 at the end 41 and, near the other end 42, lugs 35 of a bayonet coupling system.

There is a circular abutment 36 between the lugs 35 and the gripping means 33.

On the inside of the coupling sleeve 2 are two retaining projections 38 offset by 180° and adapted to cooperate with the edge of the groove 26 adjacent the openings 27.

Near the projections 38 and also offset by 180° are two pre-locking tongues 39 and two locking studs 40 which respectively pre-lock and lock the electrical contact members 6. The tongues 39 have a thinner portion 39*a* on the side towards the end 41.

Finally, two abutments 43 near the end 42 offset by 180° are each extended by a pre-locking strip 44, the latter having on their side facing towards the housing member 1 a protuberance 45 adapted to cooperate with a recess 46 on the skirt 19.

Figure 6:
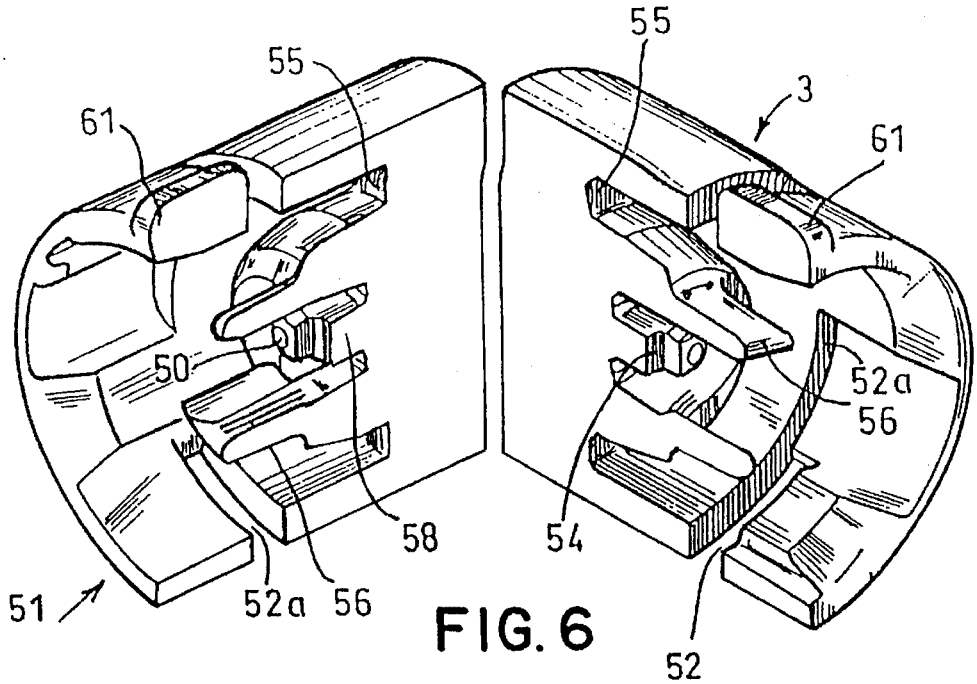
FIG. 6 is an exploded perspective view showing the complementary member in cross-section.
Figure 7:
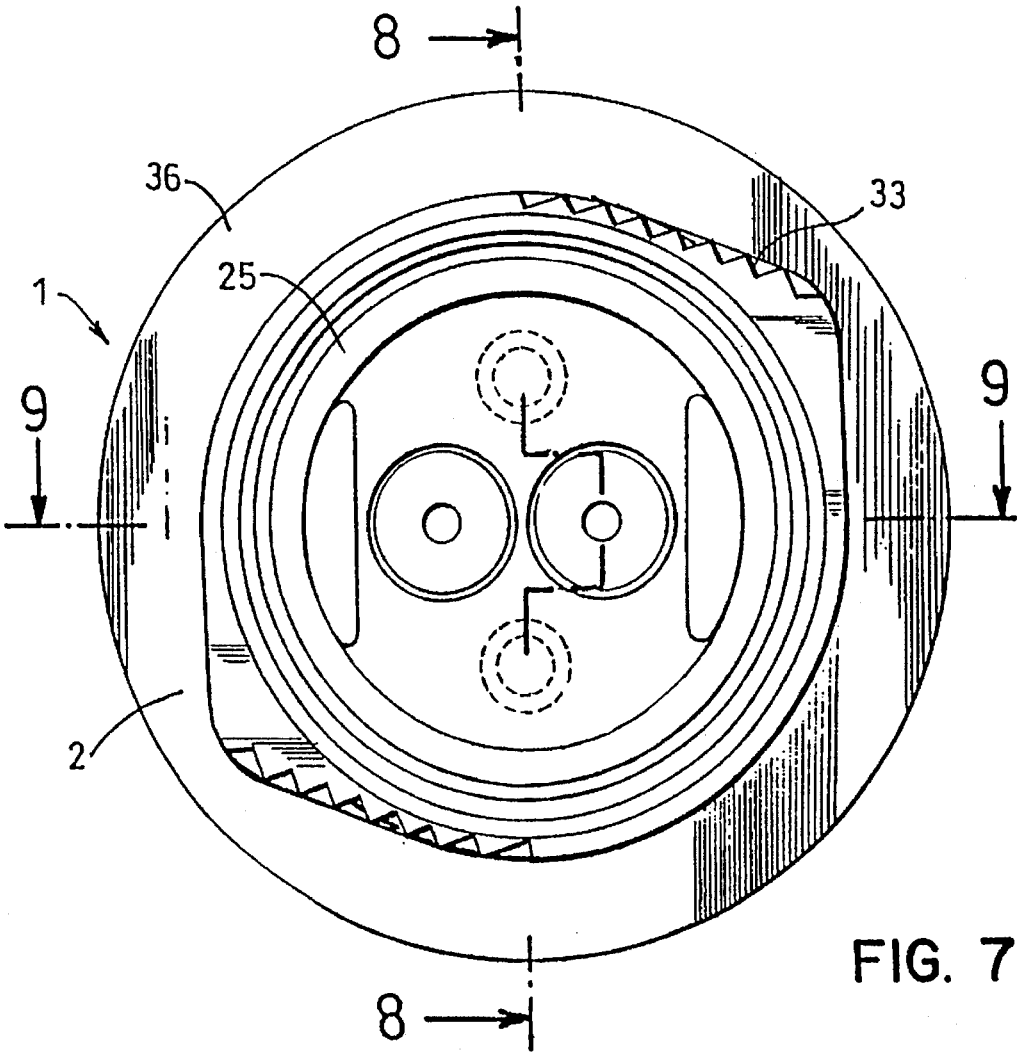
FIG. 7 is an end-on elevations view of the assembled connector.

The complementary member 3 (see FIG. 6) is a fixed member that may be fixed in the engine compartment of a vehicle, for example. It includes contacts 50 that are connected to circuits, for example printed circuits, and are adapted to cooperate with the buffers 18.

The complementary member 3 is extended by a bushing 51 which has on its inside complementary bayonet coupling members 52 with ramps 52*a* adapted to cooperate with the lugs 35.

At the back of the bushing 51, between the contacts 50, there is a recess 54 into which the centering lug 20 is inserted. The free end of the skirt 19 engages in a groove running around the contacts 50.

Upstanding from the back of the bush 51 are two fingers 56 offset by 180° and adapted to cooperate with the surface of the housing member 1 between the tongues 29 and the steps 24.

Figure 9:
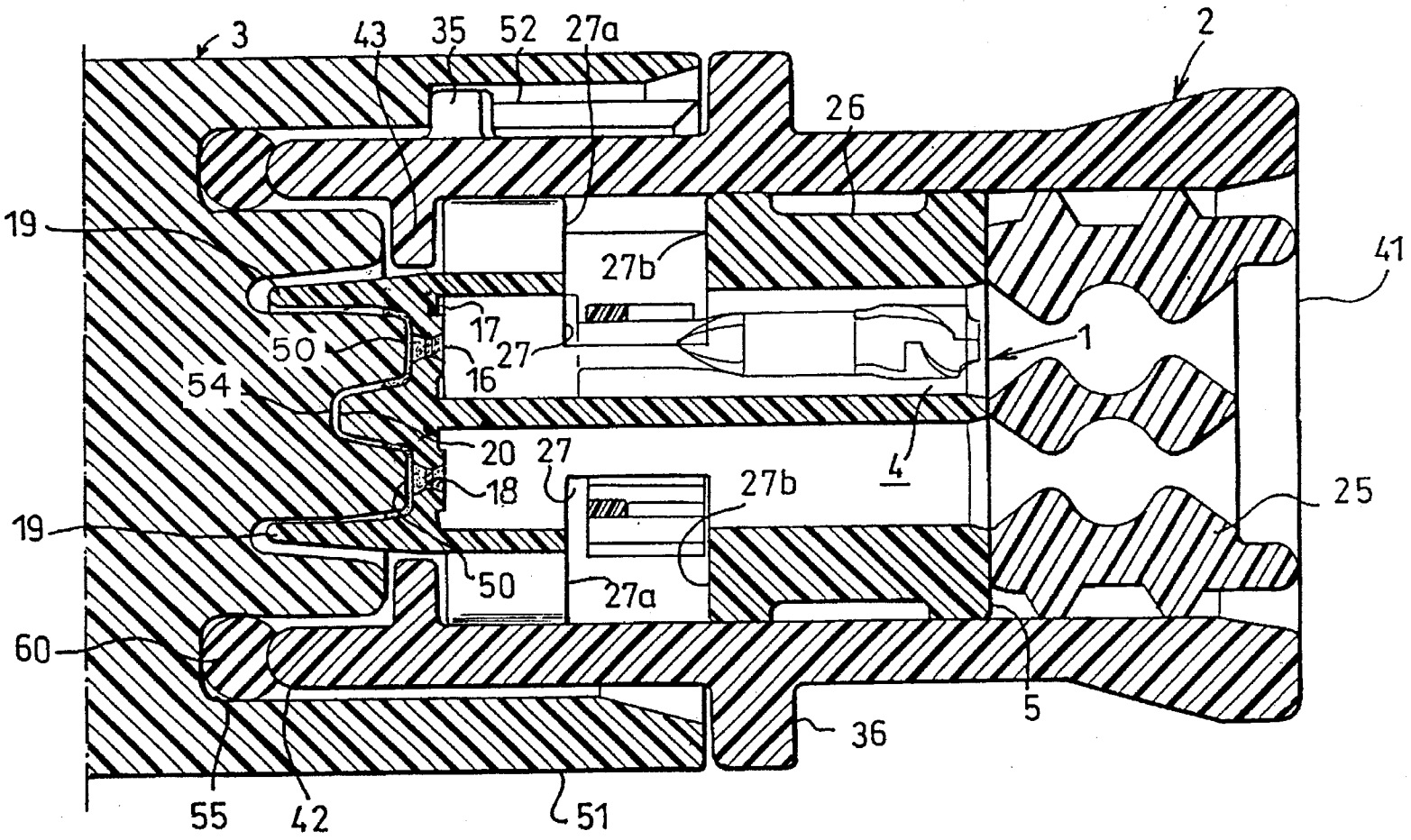
FIG. 9 is a cross-sectional view along line 9—9 in FIG. 7.
Figure 10:
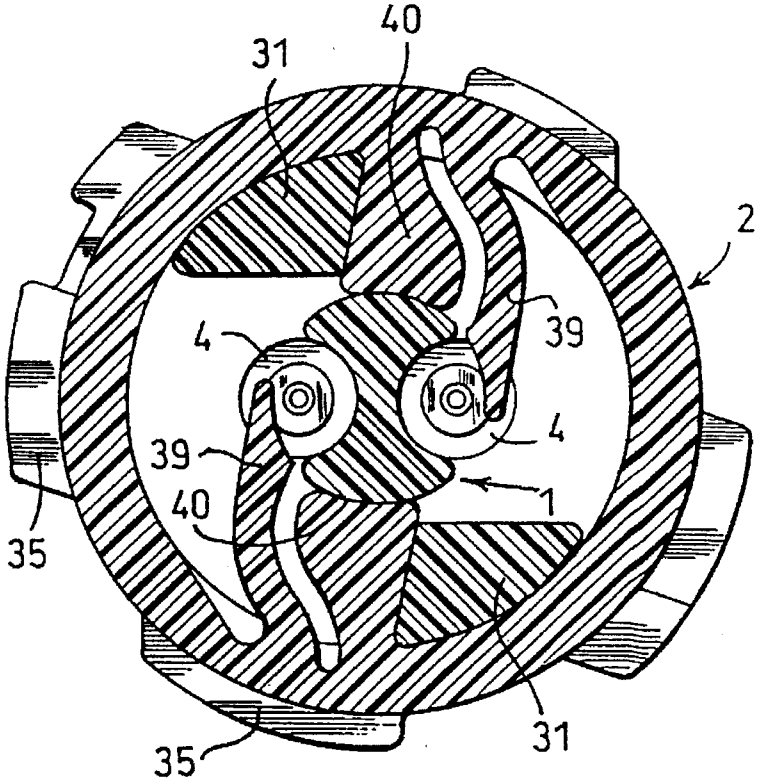
FIG. 10 is a cross-sectional view along line 10—10 in FIG. 8.
Figure 12:
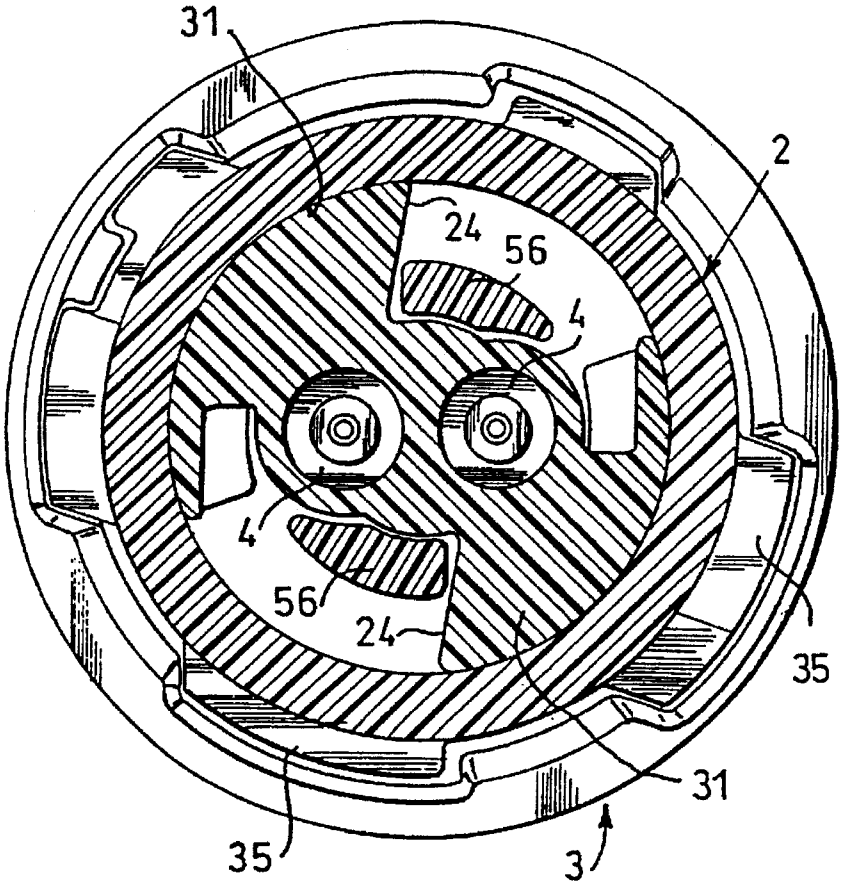
FIG. 12 is a cross-sectional view along line 12—12 in FIG. 8.

The end 42 of the coupling sleeve 2 is inserted in a groove 55 on the bushing 51 which contains an O-ring seal 60 (see FIG. 9).

The bushing 51 has a boss 61 and the circular abutment 36 has a corresponding boss 62, these bosses being such that when they are in the same angular position the end 42 can be engaged in the bushing 51 and when the boss 62 is offset angularly from the boss 61 the members are locked together.

Figure 11:
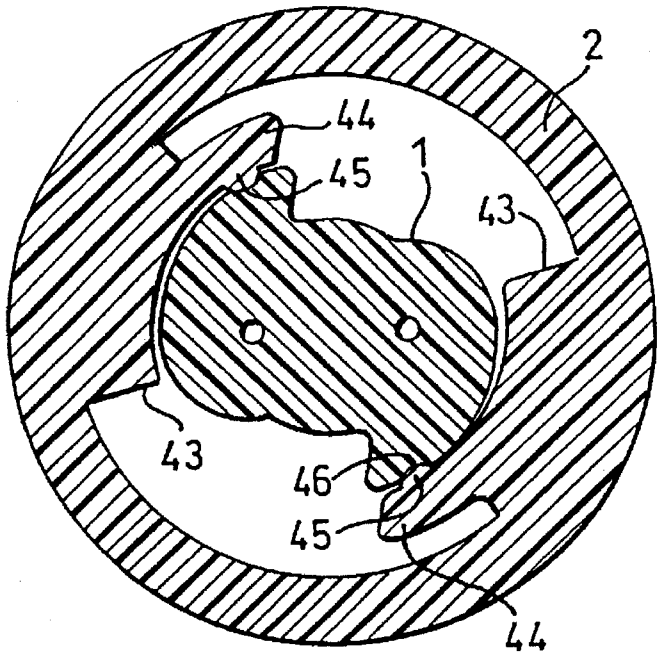
FIG. 11 is a cross-sectional view along line 11—11 in FIG. 8.
Figure 14:
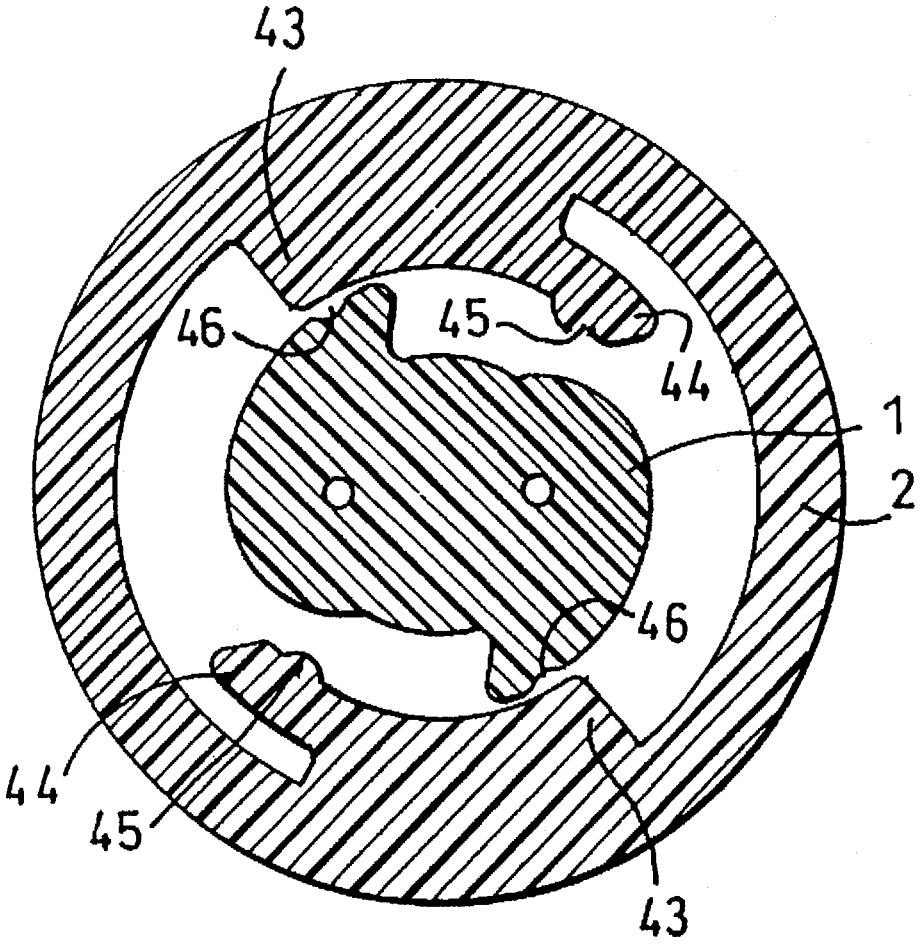
FIG. 14 is a cross-sectional view similar to FIG. 11, showing the connector when locked.

The housing member 1 is engaged in the coupling sleeve 2 so that the edge of the locking studs 40 and the pre-locking tongues 39 pass between the tongues 39 and the steps 24 until the edges 27*b* of the cut-outs 27 abut against the studs 40. In this position (see FIG. 11), the protuberances 45 are inserted in the recesses 46 and as a result the two members 1 and 2 are locked together angularly. Also, the projections 38 are engaged in the groove 26 with the result that the housing member 1 can no longer be removed from the sleeve 2.

The contact members 6 can be mounted in the passages 4 by pushing them in until they abut against the wall 17. When they are fitted they push the pre-locking tongues 39 resiliently apart, which is made easier by the thinner portions 39*a* that the latter comprise towards the end 41.

When the contact members 6 are abutted against the wall 17, the pre-locking tongues 39 bear against the rod 9 and thus cooperate with the shoulder 10.

The coupling sleeve can then be coupled to the complementary member 3, which is preferably fixed, said sleeve 2 being positioned in such a way that the bosses 61 and 62 are aligned. The sleeve 2 is engaged in the bushing 51 so that the lugs 35 are inserted into the complementary members 52 of the bayonet coupling system. The centering lug 20 of the housing member 1 then enters the recess 54 and the fingers 56 cooperate with the lateral surface of the skirt 19 along the steps 24. The housing member 1 and the complementary member are therefore locked together angularly and the ends 8, which bear against the buffers 18, are perfectly centered relative to the contacts 50 so that a perfect electrical connection is obtained.

Figure 13:
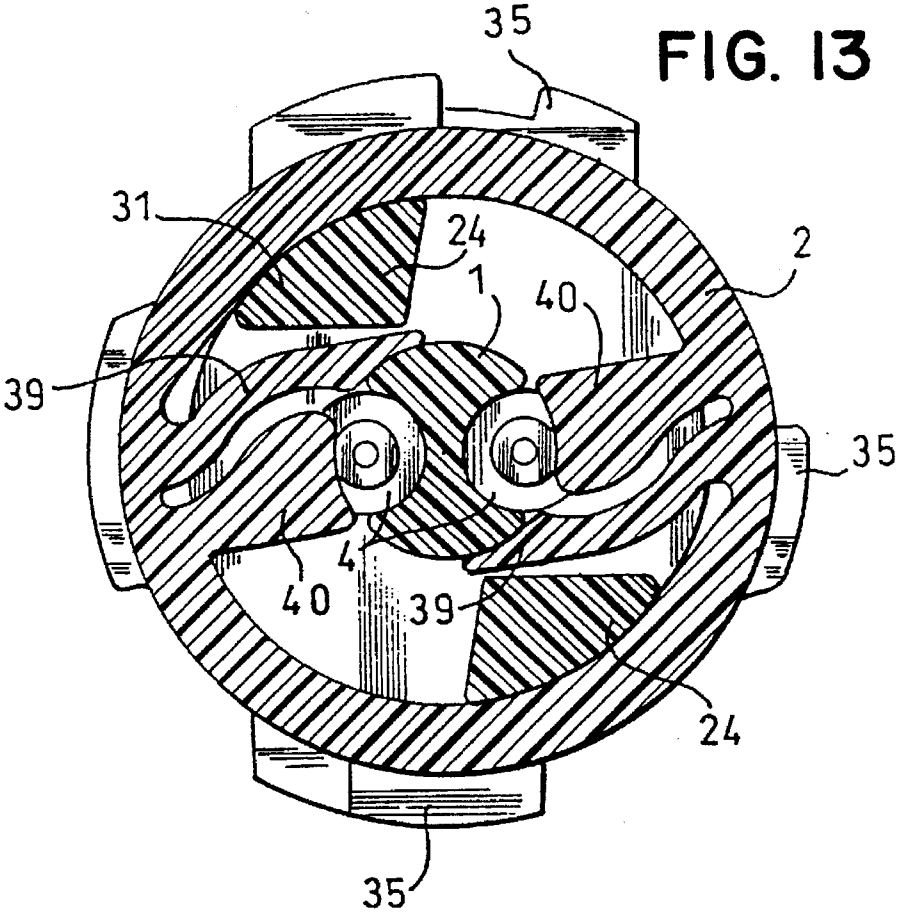
FIG. 13 is a view similar to FIG. 10, showing the connector when locked.

To lock the housing member 1 to the sleeve 2 and the latter to the complementary member 3 and to lock the member 6 in the passages 4, the sleeve 2 is turned so that the lugs 35 are at the ends of the ramps 52*a* of the bayonet coupling system (see FIG. 13). The studs 40 then engage in the cut-outs 27 and lock the members 6 in the passages 4. Note that when the sleeve 2 is in the locked position the protuberances 45 are away from the recesses 46.

Accordingly, by movement of just the sleeve 2, the members 6 are locked in the passages and simultaneously the housing member 1 is locked to the complementary member 3.

Of course, the invention is not limited to the embodiment just described and shown. Numerous modifications of detail may be made thereto without departing from the scope of the invention.

There is claimed:

1. Electrical connector comprising:

a housing member including passages adapted to contain first electrical contact members fixed to ends of electrical conductors;

a complementary member including second electrical contact members adapted to cooperate with the first electrical contact members;

a coupling sleeve including means for receiving said housing member, means for pre-locking said first electrical contact members in said passages, means for locking said first electrical contact members inserted in said passages, and means for fixing said coupling sleeve to said complementary member; and said housing member, said complementary member and said coupling sleeve being constructed and arranged so that turning of said coupling sleeve relative to said complementary member simultaneously locks said coupling sleeve and said complementary member and positions said means for locking to lock said first electrical contact members in said passages.

2. Electrical connector according to claim 1, wherein said housing member and said complementary member comprise means for locking said housing member and said complementary member angularly together.

3. Electrical connector according to claim 1, wherein:

said housing member comprises a body having a first end, a second end and an intermediate part therebetween, a groove located near said first end, and cut-outs located in said intermediate part opening into said passages;

said coupling sleeve comprises internal projections adapted to cooperate with said groove;

said means for pre-locking comprise pre-locking tongues adapted to be inserted into said cut-outs;

said means for locking comprise locking studs; and said pre-locking tongues are adapted to cooperate with shoulders on said first electrical contact members in a pre-lock position, and said locking studs cooperate with said shoulders upon turning of said coupling sleeve.

4. Electrical connector according to claim 3, wherein said coupling sleeve comprises a side including a pre-locking strip, said pre-locking strip including a protuberance adapted to cooperate with a recess in said housing member in said pre-locked position of said coupling sleeve.

5. Electrical connector according to claim 2, comprising a centering lug and a skirt around said centering lug on said housing member on an end facing said complementary member.

6. Electrical connector according to claim 5, wherein said complementary member comprises a bushing adapted to receive a corresponding end of said coupling sleeve, said bushing including a back portion, a recess at said back portion adapted to receive said centering lug, a groove in which said skirt is inserted, and fingers upstanding from the back portion of said bushing adapted to cooperate with said skirt and steps formed in sectors of said housing member.

7. Electrical connector according to claim 6, wherein said means for fixing said coupling sleeve and said complementary member together comprise a bayonet coupling system.

8. Electrical connector according to claim 1, wherein said housing member includes an first end facing said complementary member and a second end opposite said first end, said second end including pillars adapted to extend inside said coupling sleeve and fix a seal.

9. Electrical connector according to claim 3, wherein said housing member and said complementary member comprise means for locking said housing member and said complementary member angularly together.

10. Electrical connector according to claim 4, wherein said housing member and said complementary member comprise means for locking said housing member and said complementary member angularly together.

11. Electrical connector according to claim 6, wherein said housing member and said complementary member comprise means for locking said housing member and said complementary member angularly together.

12. Electrical connector comprising:

a housing member including passages adapted to contain first electrical contact members fixed to ends of electrical conductors;

a complementary member including second electrical contact members adapted to cooperate with the first electrical contact members;

a coupling sleeve comprising a bushing for receiving said housing member, elements associated with said bushing for pre-locking said first electrical contact members in said passages, locking members for locking said first electrical contact members inserted in said passages, and a mechanism for fixing said coupling sleeve to said complementary member; and said housing member, said complementary member and said coupling sleeve being constructed and arranged so that turning of said coupling sleeve relative to said complementary member simultaneously locks said coupling sleeve and said complementary member and positions said locking members so that the locking members lock said first electrical contact members in said passages.

* * * * *